US008256408B2

(12) United States Patent
Bucher et al.

(10) Patent No.: US 8,256,408 B2
(45) Date of Patent: Sep. 4, 2012

(54) MOUNTING PLATE FOR A WIRE SAWING DEVICE, WIRE SAWING DEVICE COMPRISING THE SAME, AND WIRE SAWING PROCESS CARRIED OUT BY THE DEVICE

(75) Inventors: Niklaus Johann Bucher, Flims Waldhaus (CH); David Baranes, Lausanne (CH); Philippe Nasch, Le Mont-sur-Lausanne (CH)

(73) Assignee: Applied Materials Switzerland SA, Cheseaux-sur-Lausanne (CH)

( * ) Notice: Subject to any disclaimer, the term of this patent is extended or adjusted under 35 U.S.C. 154(b) by 0 days.

(21) Appl. No.: 12/863,177

(22) PCT Filed: Feb. 23, 2009

(86) PCT No.: PCT/IB2009/000321

§ 371 (c)(1),
(2), (4) Date: Dec. 13, 2010

(87) PCT Pub. No.: WO2009/130549

PCT Pub. Date: Oct. 29, 2009

(65) Prior Publication Data

US 2011/0083655 A1 Apr. 14, 2011

(30) Foreign Application Priority Data

Apr. 23, 2008 (EP) ..... 08007834

(51) Int. Cl.
*B28D 1/08* (2006.01)

(52) U.S. Cl. ..... 125/16.01; 125/21; 125/22

(58) Field of Classification Search ..... 125/16.01, 125/21, 22

See application file for complete search history.

(56) References Cited

U.S. PATENT DOCUMENTS

| | | | | |
|---|---|---|---|---|
| 5,851,636 | A * | 12/1998 | Lang et al. | 428/167 |
| 5,904,136 | A * | 5/1999 | Nagatsuka et al. | 125/16.02 |
| 6,035,845 | A * | 3/2000 | Kaser | 125/16.02 |
| 6,056,031 | A * | 5/2000 | Banzawa et al. | 156/378 |
| 7,025,665 | B2 * | 4/2006 | Bender | 451/296 |
| 7,971,584 | B2 * | 7/2011 | Wiesner | 125/22 |
| 2001/0051683 | A1 * | 12/2001 | Honma et al. | 524/425 |
| 2005/0217656 | A1 | 10/2005 | Bender | |

(Continued)

FOREIGN PATENT DOCUMENTS

EP 1555101 A 7/2005

OTHER PUBLICATIONS

PCT International Search Report, dated May 25, 2009, PCT/IB/2009/000321.

(Continued)

*Primary Examiner* — Maurina Rachuba

(74) *Attorney, Agent, or Firm* — Patterson & Sheridan, LLP

(57) ABSTRACT

The device (1) for wire sawing of a piece (10) to be sawed that is mounted on a support table (20) comprises fastening means (15, 26, 40) for fastening said piece (10) to be sawed to a carriage (18) apt to cooperate with a guide rail of said support table (20), said fastening means (15, 26, 40) consisting of a mounting plate (15) apt to be manufactured to which said piece (10) to be sawed is bonded, and of anchoring means (26, 40) for anchoring said mounting plate (15) directly on said carriage (18).

13 Claims, 8 Drawing Sheets

U.S. PATENT DOCUMENTS

| | | | | |
|---|---|---|---|---|
| 2007/0283944 | A1* | 12/2007 | Hukin | 125/16.02 |
| 2008/0142160 | A1* | 6/2008 | Ueda et al. | 156/345.51 |
| 2011/0061688 | A1* | 3/2011 | Schnyder et al. | 134/34 |
| 2011/0100348 | A1* | 5/2011 | Bucher et al. | 125/21 |

OTHER PUBLICATIONS

Australian Office Action, Application No. 2009239747 dated Feb. 22, 2012.

* cited by examiner

MOUNTING PLATE FOR A WIRE SAWING DEVICE, WIRE SAWING DEVICE COMPRISING THE SAME, AND WIRE SAWING PROCESS CARRIED OUT BY THE DEVICE

The present invention relates to a mounting plate for a wire sawing device. It also relates to a wire sawing device comprising such a mounting plate, the device being designed to saw at least one piece to be sawed and comprising at least one layer of wires stretched out between at least two wire guide cylinders, said layer of wires being held in place by grooves provided on the surface of the wire guide cylinders, said wires being adapted to move in a reciprocating or continuous motion while bearing against at least one piece to be sawed that is fastened to at least one support table, while means of displacement are provided to accomplish a relative forward movement between the piece to be sawed and said layer of wires. The invention further relates to a wire sawing process carried out by such a wire sawing device.

Wire sawing devices and processes of the type just cited that implement a displacement of the wires of the layer of wires or of the piece to be sawed are already known, especially in the industry of electronic components of ferrites, quartzes, and silicas, as well as in the Photovoltaic industry, for winning thin slices of materials such as polycrystalline or single-crystal silicon or of materials such as GaAs, InP, GGG, or again quartz, synthetic sapphire, and ceramic materials. In technologies, such as semi-conductor technology, the slices are called wafers.

In the known devices, the sawing section consists of a set of at least two cylinders placed in parallel. These cylinders, called wire guides, have grooves engraved into their surface that define the interval between the wires of the layer, and hence the thickness of the slices.

The piece to be sawed is named an ingot. It is fastened to a support table that moves perpendicularly to the layer of wires. The speed with which it moves defines the cutting speed. Renewal of the wire and control of its tension occur in a part called wire management section that is situated outside of the sawing section proper. The sawing is accomplished by means of an abrasive agent that is, either an abrasive fixed on the wire or a free abrasive brought in as a slurry. The wire merely acts as the transport agent. The pieces to be sawed, often come in the shape of a cylinder with quadrilateral, pseudo-quadrilateral, or circular base.

In known wire sawing devices such as illustrated in FIG. 13, the piece 110 to be sawed is fastened to the support table 120 in an indirect way. The piece 110 to be sawed is bonded to a temporary plate 112, usually known as a "beam", that in turn is bonded to an assembly plate 114, usually known as a "gluing plate". The to assembly plate 114 in turn is fastened with assembly screws 116 to an ingot holder, e.g. a carriage 118 engaged in a guide rail of support table 120, and fastened to this support table 120.

Temporary plate 112 is a disposable part. It is made of glass or of a synthetic material, such as a thermoplastic material or a thermoset material or a composite material, into which the sawing wires penetrate after having cut through the piece 110 to be sawed.

Temporary plates made of glass offer a very good stability and eliminate the risk of warping of the slices obtained. Usually glass plates are produced at low cost. However, they become high cost products as soon as they need to be provided with cavities, such as holes and/or grooves and/or channels, because such cavities can only be obtained by machining the glass plates, which is an expensive process.

Temporary plates made of a synthetic material have the advantage that various designs of the plates can be achieved much easier due to the manufacturing option, but may have the disadvantage of undergoing warping deformation of the slices obtained. Also a plate made of a synthetic material such as a thermoplastic material or a thermoset material or a composite material shows a higher unit price than a glass plate.

Assembly plate 114 is made of a metallic material, for instance steel or aluminium. It is designed to be reused, so that after each sawing operation its surface must be cleaned, since the temporary plate 112 had been bonded to it during the previous operation.

In the usual sawing process, the piece to be sawed is taken out of the wire sawing device when the sawing operation is finished. It appears as a set of parallel slices separated from each other by the saw nick or sawing gap, and at their base these slices are attached to a lug that is part of the temporary plate of glass or synthetic material into which the wires of the layer of wires have partially penetrated.

Because of the presence of the abrasive agent such as slurry, the slices tend to stick to each other due to a capillarity effect, this effect starting while the slicing process is still ongoing, but being emphasized once the slicing process is accomplished, the slices still hanging on the lug.

Then the complete holding set, comprised of the ingot holder, the gluing plate, the beam and the piece sawed into slices attached to the lug, is taken off from the sawing device. This means, the slices are submitted to cleaning operations that occur outside the wire saw area. First, the slices still mounted on the holding set are immersed in a washing bath or in a rinsing bath, prior to a further washing or rinsing operation. The steps of washing, rinsing and separating the slices take place outside the sawing device.

One aim of the present invention is that of providing a mounting plate, a wire sawing device, and a wire sawing process overcoming the above-mentioned disadvantages.

According to a first aspect, the invention relates to a mounting plate for a wire sawing device that is obtained by extrusion of a ceramic material and comprises at least one groove on one of its faces.

According to a particular feature of the mounting plate, it comprises at least one channel running between two of its opposite sides.

Further features of the mounting plate are defined in the appended claims 2, 4 and 5.

According to a second aspect, the invention relates to a wire sawing device designed to saw at least one piece to be sawed and comprising at least one layer of wires stretched out between at least two wire guide cylinders, said layer of wires being held in place by grooves provided on the surface of the wire guide cylinders, said wires being adapted to move in a reciprocating or continuous motion while bearing against at least one piece to be sawed that is fastened to at least one support table, while means of displacement are provided to accomplish a relative forward movement between the piece to be sawed and said layer of wires further comprising fastening means for fastening said piece to be sawed to a carriage cooperating with a guide rail of said support table, said fastening means consisting of a mounting plate according to the first aspect of the invention to which said piece to be sawed is bonded and of anchoring means for anchoring said mounting plate directly on said carriage.

Said support table is a plate attached to a clamping table in a cutting head of the sawing device.

Such a device advantageously comprises a single mounting plate for fastening the piece to be sawed to the support table, instead of the two adjacent plates of the prior art, i.e. the assembly plate and the temporary plate. This mounting plate cannot be reused, since the sawing wires cut into it after they have gone through the piece to be sawed. By using only a single mounting plate instead of the previous two plates, the operations of detaching the temporary plate from the assembly plate is suppressed, which is saving time and cost since.

According to a particular feature of the wire sawing device, the mounting plate comprises at least one channel connected with at least one means for supplying a fluid.

Further features of the wire sawing device are found in appended claims 7 to 11.

According to a third aspect, the invention relates to a process of wire sawing of at least one piece to be sawed by means of at least one layer of wires stretched out between at least two wire guide cylinders, said layer of wires being held in place by grooves provided in the surface of the wire guide cylinders, said wires being adapted to move in a reciprocating or continuous motion while bearing against said at least one piece to be sawed that is fastened to at least one support table, the sawing being achieved by a relative motion of advance between said piece to be sawed and said layer of wires. In addition, the wire sawing process is carried out by a wire sawing device according to the second aspect of the invention, said device having a mounting plate provided with at least one channel, the wires of the layer of wires going through the piece to be sawed while creating slices separated by sawing slots.

The channel(s) of the mounting plate can be used for different purposes at different steps of the sawing process. It can be used to have a washing liquid or a rinsing liquid circulating in the mounting plate. It also can be used to have a cooling medium or a heating medium circulating in the mounting plate.

The invention will be better understood on reading the following detailed description of particular embodiments of the mounting plate and of the wire sawing device that are given as illustrations not in any way limiting, while referring to the appended drawings in which.

Figure 13:
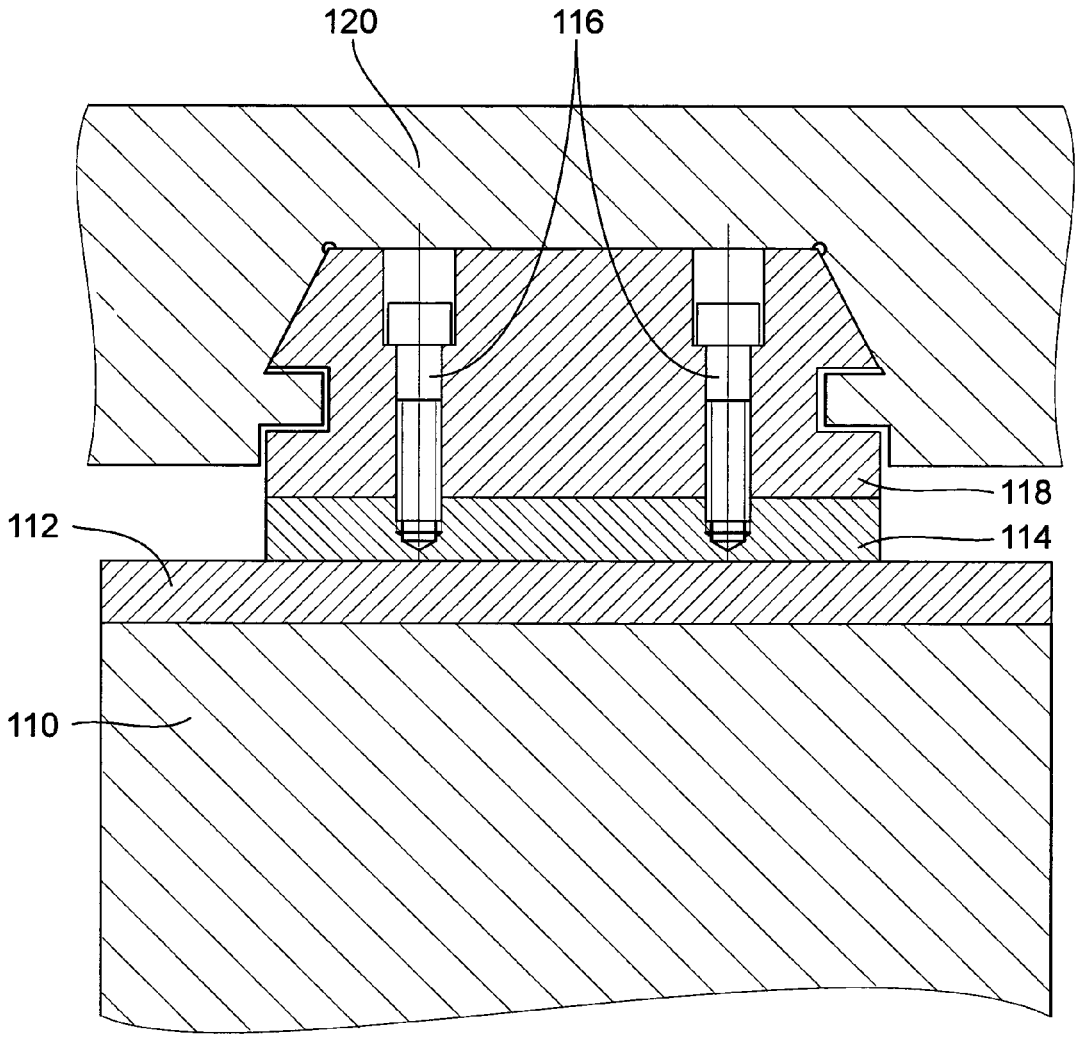

FIG. 13, already described, illustrates how the piece to be sawed is fastened to the support table via a temporary plate and an assembly plate in accordance with the prior art.

Figure 1:
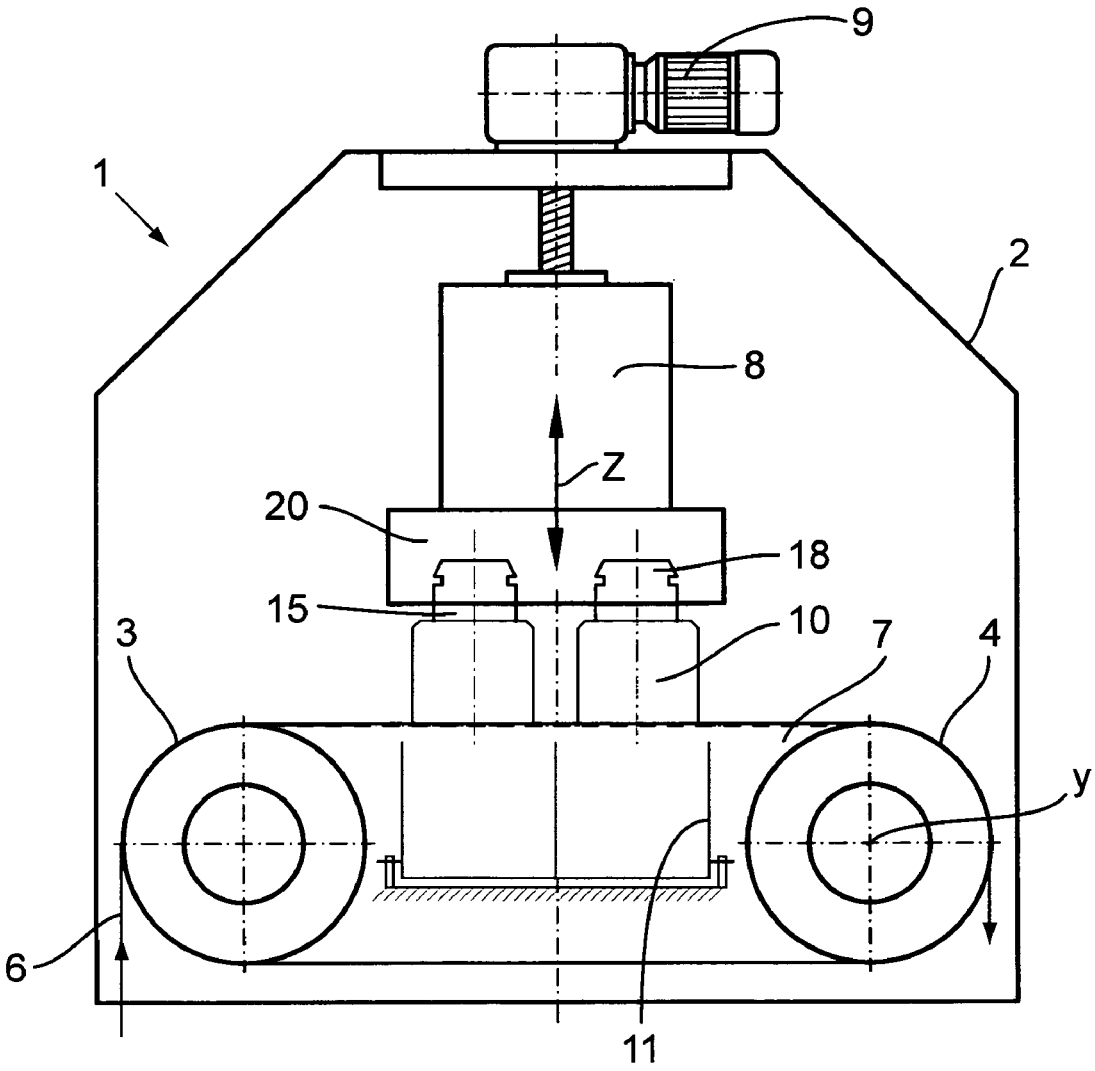
FIG. 1 is a front view of a wire sawing device in accordance with the invention.

With reference to FIG. 1, the wire sawing device 1 comprises a frame 2 and wire guide cylinders 3, 4, here two, mounted on frame 2 with their axes in parallel, it being understood that the device could have more than two cylinders, for example four.

The wire 6 is taken off from a supply spool, not shown, and then wound around the wire guide cylinders 3, 4 to form at least one layer 7 of parallel wires in a sawing section. Wire 6 is then recovered in a suitable device, not illustrated, such as a receiving spool or a recovery vessel.

One or two pieces 10 to be sawed, or more of them, such as ingots consisting of a hard material are mounted on a support table 20 inside a cutting head.

Support table 20 can be shifted vertically in the Z-direction thanks to a column 8 and a motor 9 so that the pieces 10 to be sawed are pressed against the layer 7 of wires.

The periphery of the wire guide cylinders 3, 4 is engraved with grooves that define the interval between adjacent wires of the layer 7 of wires, and hence the thickness of the sawed slices. These slices are separated from each other by sawing slots.

Wire 6 is stretched and also guided and pulled by the wire guide cylinders 3, 4 so as to move in a continuous or reciprocating movement in the embodiment illustrated. This wire 6 preferably consists of spring steel having a diameter between 0.08 and 0.3 mm, in particular between 0.1 and 0.2 mm, in order to saw blocks of hard materials or of more particular compositions notably for the industries of semiconductors, photovoltaic and solar installations, or ceramics, such as silicon, ceramics, compounds of the elements of groups III-V and II-VI, GGG (gadolinium-gallium garnet), sapphire, etc., into slices having thicknesses of at least about 0.08 to 0.1 mm and at most 8 to 15 mm, for example 10 mm or 12 mm. The abrasive agent is a commercial product, and can be diamond, silicon carbide, alumina, etc. fixed on the wire or free in suspension in a liquid that serves as the transport agent for the abrasive particles.

Each piece 10 to be sawed is bonded, by means of glue or cement or any other bonding agent, to a bonding face 152 (see FIG. 2) of a mounting plate 15 mounted on a support table 20.

It will now be described while referring to FIG. 2 how the mounting plate 15 is mounted on support table 20. This is accomplished by means of an ingot holder, which is a carriage 18 in the example illustrated. To this end carriage 18 includes lateral grooves 22 able to cooperate with slide rails (not illustrated) of the support table 20 so that said carriage 18 may be installed on said support table 20. The carriage 18 has at least two through bores 24 designed to receive anchoring screws 16, as illustrated on the right-hand side of FIG. 2. In a variant screw 16 could have a conical head installed in anchoring groove 26 and nuts are being screwed on said screws through bores 24. Advantageously, a carriage 18 may be used that is similar to the carriages 118 of the prior art described while referring to FIG. 13.

On its face 154 opposite to the bonding face 152, mounting plate 15 has anchoring grooves 26 extending parallel to each other in a direction intended to be perpendicular to directions Y and Z when the mounting plate 15 is mounted on the support table 20 by means of carriage 18. These anchoring grooves 26 preferably have a trapezoidal profile as illustrated on the left-hand side of FIG. 2. Alternatively, grooves 26 have a rectangular profile as illustrated on FIG. 3.

Figure 2:
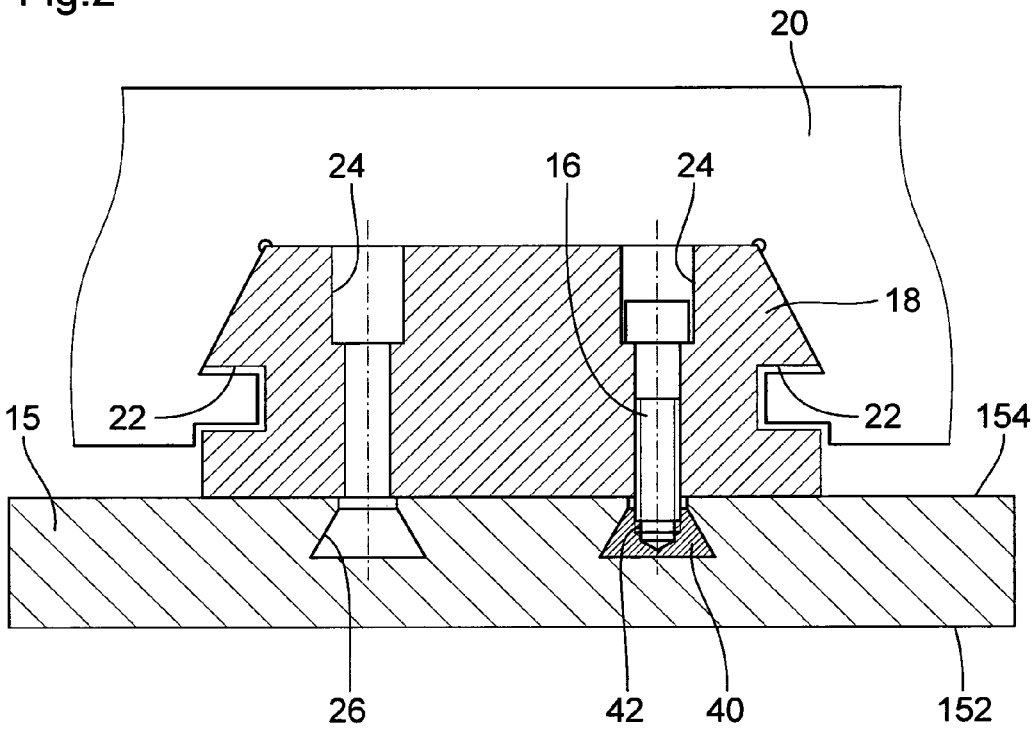
FIG. 2 represents a first embodiment of a mounting plate anchored on a carriage, in a section following a plane parallel to the sawing wires and perpendicular to the layer of wires.
Figure 3:
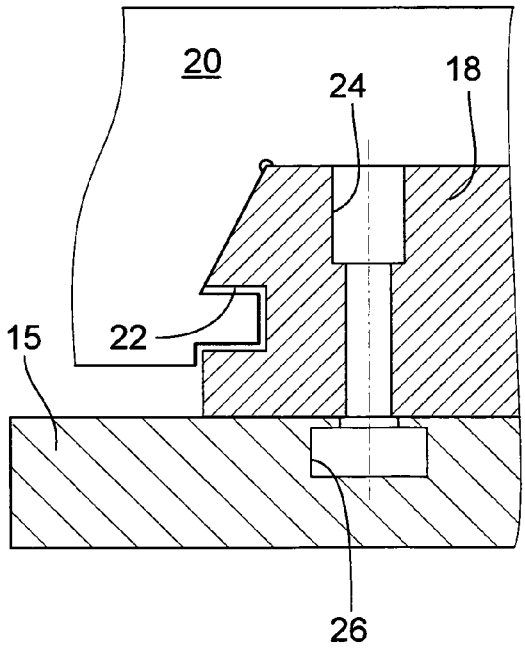
FIG. 3 is similar to FIG. 2 and shows a partial view of a second embodiment of the mounting plate.

Said anchoring grooves 26 are designed to cooperate with skids 40, as illustrated on the right-hand side of FIG. 2. Skids 40 preferably have a profile of trapezoidal shape complementary to that of the anchoring grooves 26. When the profiles are of trapezoidal shape, a dovetail assembly is realised. Skids 40 are slidingly introduced into said anchoring grooves 26, and have threaded holes 42 receiving anchoring screws 16 on their side supposed to face the carriage 18, in order to hold carriage 18 and mounting plate 15 together. Skids 40 can be reused.

The anchoring grooves 26 preferably are realised in mounting plate 15 during its manufacturing, which involves a process of extrusion. To this end the mounting plate 15 consists of a material that can be extruded.

According to the invention, mounting plate 15 is made of a hard, brittle material such as ceramic material. Particularly said ceramic material can be a silicate ceramic. More particularly, it can be stoneware.

Such a material is particularly advantageous. Mounting plates 15 made from this material actually have stability properties similar to those of the temporary glass plates of the prior art, which guarantees that the slices obtained after sawing of the piece to be sawed are not warped.

Contrary to glass, moreover, this material has the advantage that anchoring grooves 26 having a complex profile such as a trapezoidal profile can be made while manufacturing the mounting plate 15 by an extrusion process.

Besides, mounting plates 15 made of a ceramic material have the advantage of a low price in comparison with the temporary plates of the prior art made of synthetic materials, such as thermoplastic materials, thermoset materials or composite materials. Moreover, ceramic materials offer much better stability properties than said synthetic material. Therefore it presents the advantage of being able to be manufactured under a cost effective manner, being more economical and hence providing a better cost of ownership to the end user.

Using the mounting plate 15 according to the invention, it is easy to fasten a piece 10 to be sawed to the support table 20, and take it off again. A single mounting plate 15 is used instead of both temporary plate and assembly plate of the prior art. The operations of detaching the temporary plate from the assembly plate and of cleaning the attachment face of the assembly plate are eliminated.

Figure 4:
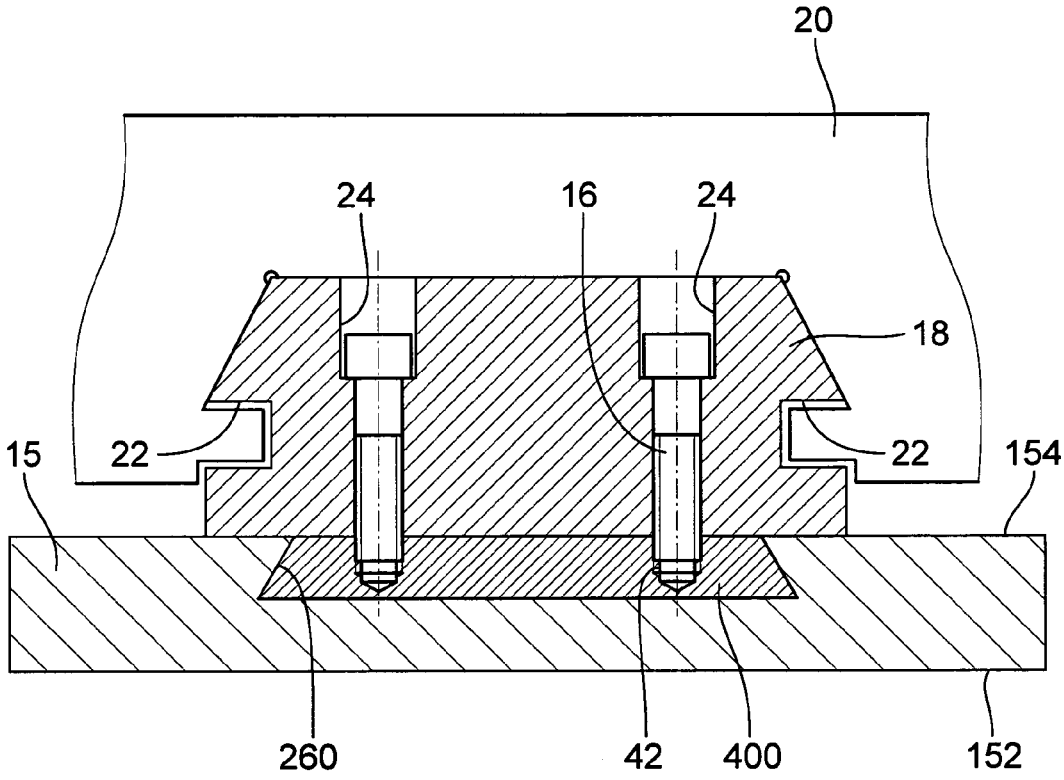
FIG. 4 is similar to FIG. 2 and shows a third embodiment of the mounting plate.

FIG. 4 shows a third embodiment of the mounting plate 15, which differs from the first embodiment of FIG. 2 in that it comprises a single anchoring groove 260 which is larger than the anchoring grooves 26 of FIG. 2, so as to cover an area substantially identical to the area covered by all of them. Said single anchoring groove 260 is designed to cooperate with a single skid 400 provided with threaded holes 42 receiving anchoring screws 16. On FIG. 4, the anchoring groove 260 and the skid 400 have complementary trapezoidal profiles, so as to realise a dovetail assembly.

The design of the mounting plate 15 is made on such manner that the plate can be of a universal use, due to the anchoring grooves 26. The skids 40 can simply be adapted to the various types of carriage 18. The skids 40 are easily introduced into the groove(s) 26 of the mounting plate 15, then the mounting plate 15 is fixed to the carriage 18 by means of the anchoring screws 16.

Another embodiment of the mounting plate 15 according to the invention will now be described while referring to FIGS. 5 and 6. According to this embodiment, the mounting plate 15 is provided with at least one channel 30 realised in the bulk of the mounting plate 15. Said channel 30 is preferably made as the time of manufacturing the mounting plate 15, by an extrusion process.

Figure 5:
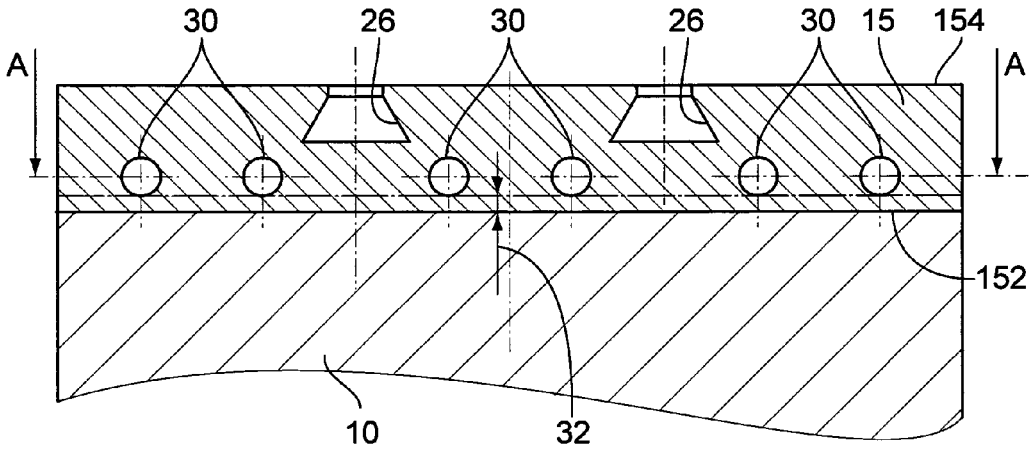
FIG. 5 shows the mounting plate of FIG. 2 prior to the sawing operation, in a section following a plan parallel to the sawing wires and perpendicular to the layer of wires.

In the example illustrated in FIG. 5, the mounting plate is provided with six channels 30 that have a circular cross section, though they could exist in a different number and have a cross section of different shape, e.g., square oval, etc. The channels 30 extend in a direction substantially parallel to faces 152, 154 of mounting plate 15, and are aligned so as to be perpendicular to the wires of the layer 7 of wires when mounting plate 15 is installed on support table 20 of the wire sawing device 1. Preferably, the channels 30 are closer to the bonding face 152 than to face 154 designed for anchoring the mounting plate 15 on carriage 18, the distance between said bonding face 152 and said channels 30 being marked by reference 32. This distance 32 is defined as the shortest distance between the bonding face 152 and the periphery of the channel 30 that is farthest from this bonding face 152. Preferably, all channels 30 are at the same distance from said bonding face.

Channels 30 allow direct washing and/or rinsing of the slices as a step of the wire sawing process. Said step of washing and/or rinsing could be supplemented by a later classical wash, which is completed outside the wire sawing device. They are adapted to admit circulation of a washing liquid and/or of a rinsing liquid, which may be products known from the prior art. Rinsing liquid can simply be water.

Depending on the nature of the product used as an abrasive agent: oil, glycol . . . , it could be sufficient to perform an single operation of rinsing the slices, by means of a rinsing liquid, or to perform a sequence of two operations: first washing the slices by means of a washing liquid and second rinsing them by means of a rinsing liquid.

Figure 6:
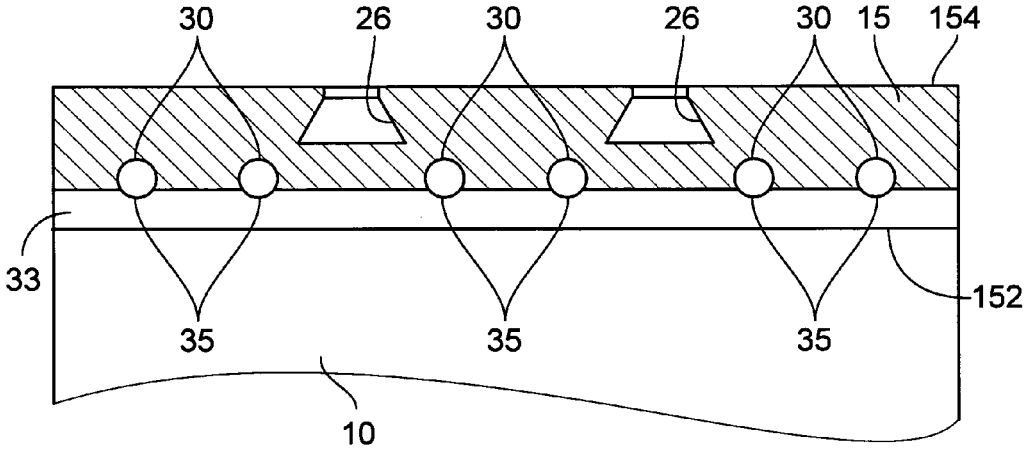
FIG. 6 shows the mounting plate of FIG. 5 after the sawing operation, in a transverse section along a sawing slot.

FIG. 6 shows the mounting plate 15 of FIG. 5, at the end of the actual sawing operation during the wire sawing process according to the invention. After having gone through the piece 10 to be sawed, which creates thin slices separated by sawing slots, the wires of the layer 7 of wires penetrate into the mounting plate 15. The relative movement between the support table 20 and the layer 7 of wires is adjusted so that the sawing wires will reach the channel(s) 30 in which the washing or rinsing liquid circulates, and penetrate into said channel(s) 30. The sawing wires create openings 35 in the channel(s) 30, said openings 35 being oriented toward the piece 10 freshly sawed.

FIG. 6 shows the mounting plate 15 in transverse section along a sawing slot, revealing the mounting plate 15 having been nicked by a sawing wire through a gap region 33 going down to the channels 30. Thus, the washing or rinsing liquid circulating in the channels 30 can flow out through the openings 35 into the sawing slots. The washing or rinsing liquid thus flows out into the gap between the slices obtained from the piece 10 to be sawed, right at the end of the sawing operation proper, when said slices are still held parallel to each other on the lugs. Therefore the slices obtained by the sawing process do not have time to stick together under the effect of capillarity of the abrasive agent.

The channels 30 can also be used at a previous stage of the sawing process, in order to have a cooling fluid circulating in the mounting plate 15. As soon as the wires of the layer of wires reach a determined depth of sawing, a cooling fluid is circulated in the channels 30, providing cooling of the portion of the piece to be sawed remaining beyond said determined depth of sawing. Circulation of a cooling fluid increases the thermal flux through the mounting plate 15, thus decreases the temperature gradient between mounting plate 15 and the piece 10 to be sawed. Then thermal stresses in the piece 10 to be sawed are reduced, thus limiting deformation and risk of defects in said piece 10 to be sawed. Said determined depth of sawing depends on the nature of the piece 10 to be sawed and/or on the abrasive agent used for the sawing operation. In some cases, circulation of the cooling agent could start at the beginning of the sawing operation. In some other cases, it could start slight later.

The channels 30 can also be used at a further stage of the sawing process, after the washing/rinsing of the slices still hanging on the carriage 18, in order to facilitate detachment of the slices from mounting plate 15. A heating fluid, such as warm liquid, hot air or steam, circulates in channels 30 of mounting plate 15, which increases the temperature of mounting plate 15, and more particularly the temperature of the interface between mounting plate 15 and the lug on which the slices are hanging. This, in turn, increases the temperature of the bonding face 152 of the mounting plate 15, helping attenuation of the bonding effect of the bonding agent. Also acid, instead of a heating fluid, can be used in order to attenuate the bonding effect of the bonding agent. During the wafer detachment operation, the detached slices are collected in a receiving vessel 11 (see FIG. 1).

FIGS. 7, 8, 9, 10, 11 and 12 represent the mounting plate 15 in a section following plane A-A of FIG. 5, and show six implementations of the arrangement is of four channels 30 in said mounting plate 15.

Figure 7:
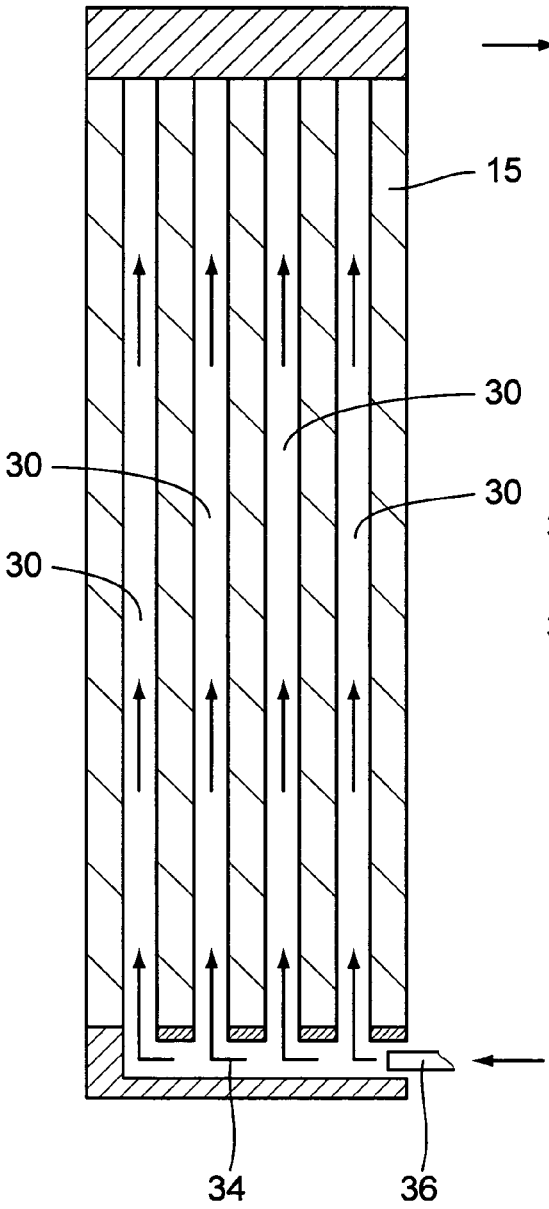
FIG. 7 represents a first implementation of a fourth embodiment of the mounting plate, in a section following plane A-A of FIG. 5.
Figure 8:
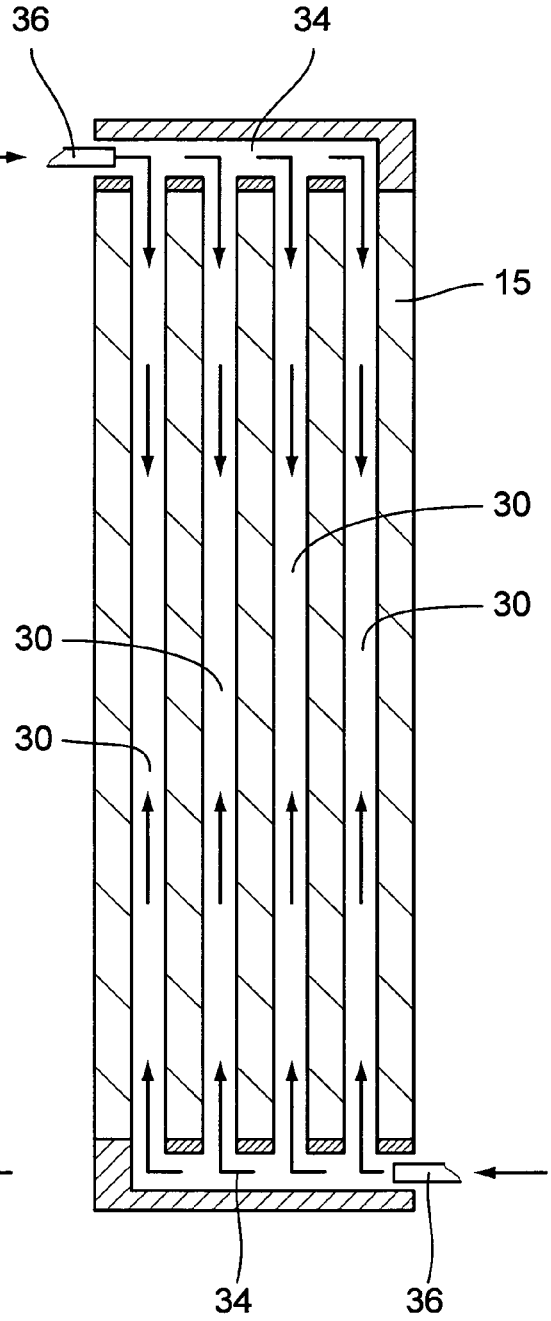
FIGS. 8, 9, 10, 11 and 12 are the analogues of FIG. 7, respectively for a second, a third, a fourth, a fifth and a sixth implementations of the fourth embodiment of the mounting plate.

In FIG. 7, the channels 30 are parallel, and at one of their ends communicate with a manifold 34 extending perpendicularly to them, and substantially in the same plane as them. In FIG. 8, the channels 30 are parallel, and at each of their ends communicate with a manifold 34 extending perpendicularly to them, and substantially in the same plane as them. Each manifold 34 is connected with a supply duct 36 for supplying the desired fluid.

Figure 9:
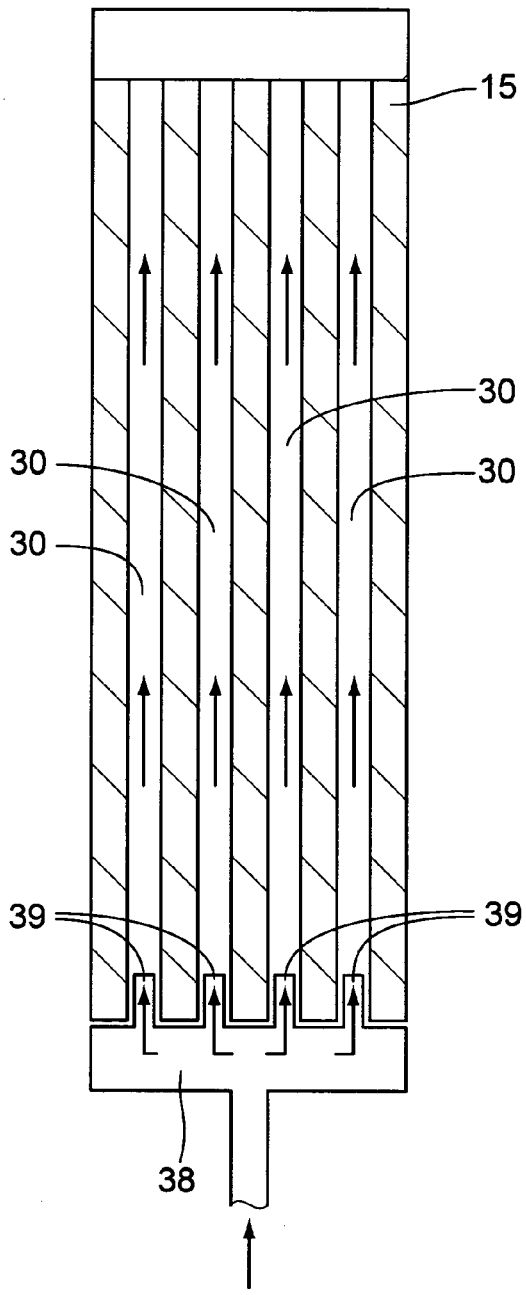
Figure 10:
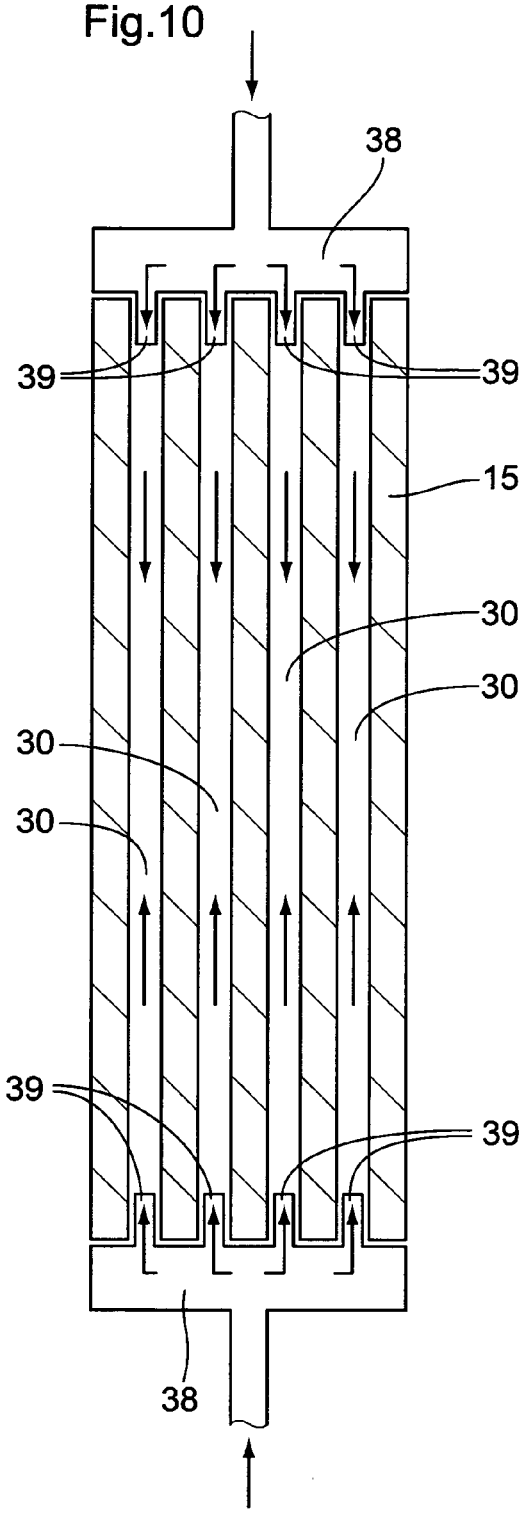

In FIG. 9, the channels 30 are parallel and open onto one side of mounting plate 15. At one of their ends they communicate with a manifold 38 for supplying the desired fluid. In FIG. 10, the channels 30 are parallel and open onto opposite sides of mounting plate 15. At each of their ends they communicate with a manifold 38 for supplying the desired fluid. Each manifold 38 has one entrance and four exits 39, each end of each channel 30 being supplied with the desired fluid via one of these exits 39.

Figure 11:
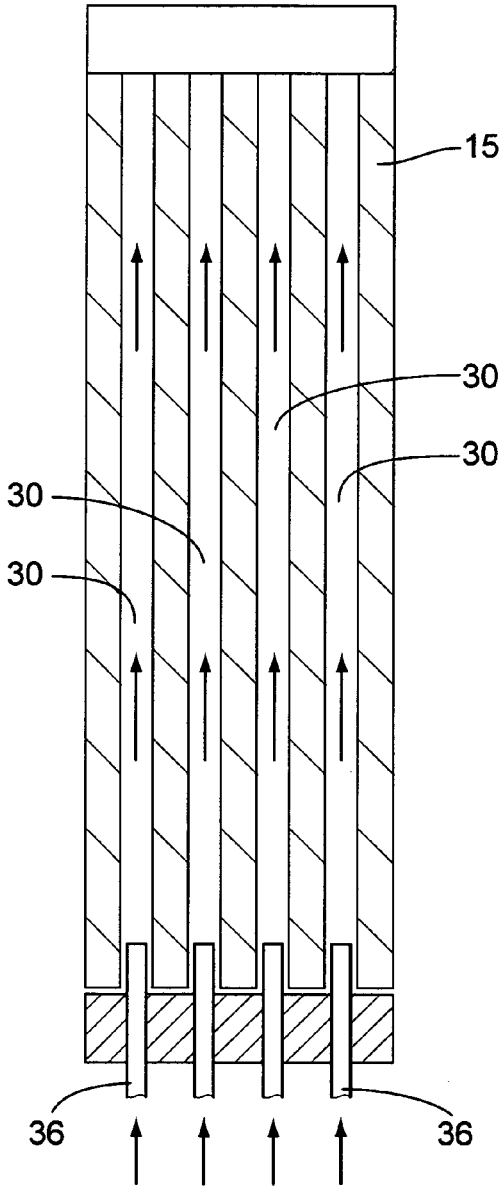
Figure 12:
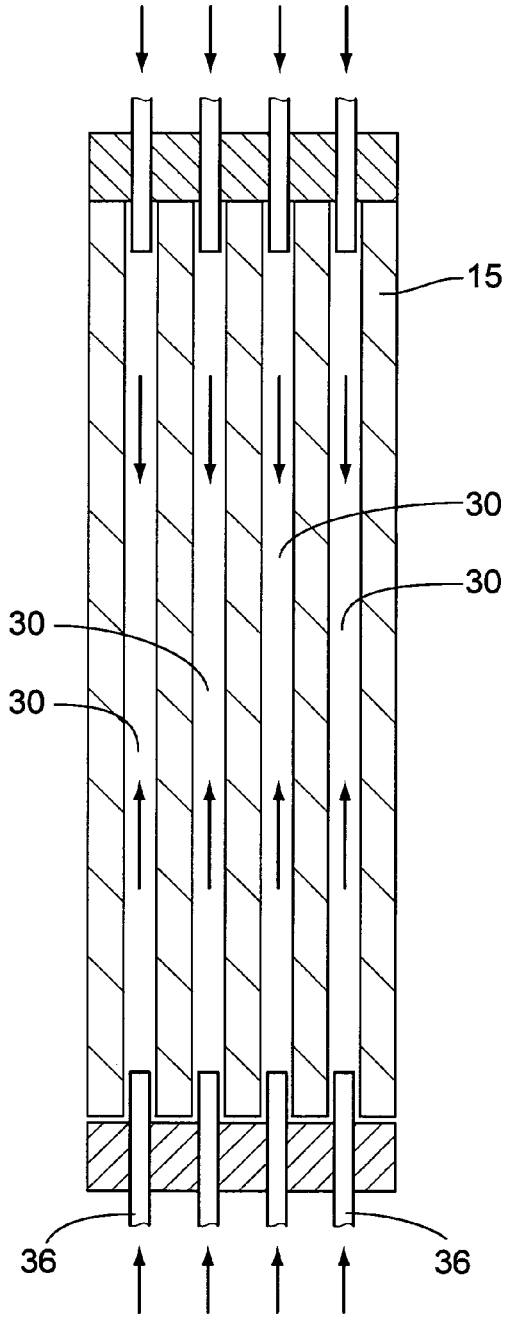

In FIG. 11, the channels 30 are parallel. Each of them communicates at one of its ends with a supply duct 36 extending parallel to it, and substantially in the same plane as it. In FIG. 12, the channels 30 are parallel. Each of them communicates at each of its ends with a supply duct 36 extending parallel to it, and substantially in the same plane as it.

According to an embodiment according to the invention, mounting plate 15 has a thickness of 15 mm or less when it is not provided with channels 30, or a thickness of 18 mm when it is provided with channels 30. In the latter case, the distance 32 between the bonding face 152 and the channels 30 is preferably below 6 mm. In variants, the mounting plate 15 could be thicker i.e. 20 mm or more.

It is understood that the invention is not limited to the embodiments and implementations that have been illustrated in the figures, but covers variants that a person skilled in the art will be able to realise.

For example, the relative movement between the support table 20 and the layer 7 of wires could equally well be realised by moving the layer 7 of wires, and by all adequate mechanical, pneumatic, and hydraulic means.

Likewise, instead of one support table 20 the wire sawing device 1 could have two or more support tables, each holding a predetermined number of ingot holders.

Likewise, mounting plate 15 could have a network of channels 30 different from the ones in FIGS. 7 to 12, and there could be a number of channels 30 different from four, but still oriented in the manner illustrated.

The invention claimed is:

1. A wire sawing device, comprising an extruded ceramic mounting plate, the mounting plate comprising at least one groove on a face thereof; and a plurality of channels provided substantially parallel to each other and running between two opposite sides of the mounting plate, at least one layer of wires stretched out between at least two wire guide cylinders, the layer of wires being held in place by disposed in grooves provided on the surface of the wire guide cylinders and being adapted to move while bearing against at least one piece to be sawed that is fastened to at least one support table;

a displacement device adapted to provide relative forward movement between the at least one piece to be sawed and the layer of wires;

a fastening device for fastening said at least one piece to be sawed to a carriage adapted to cooperate with a guide rail of said support table, wherein the fastening device comprises the mounting plate to which the at least one piece to be sawed is bonded; and an anchoring device for anchoring the mounting plate directly on the carriage.

2. The wire sawing device of claim 1, wherein the anchoring device comprises at least one groove formed in the mounting plate and at least one skid configured to slide in the groove, wherein the groove and the skid have complementary profiles.

3. The wire sawing device of claim 2, wherein the skid comprises at least one threaded hole designed to receive an anchoring screw going through the carriage.

4. The wire sawing device of claim 2, wherein the mounting plate comprises at least one channel formed in the mounting plate and extending between two opposite sides of the mounting plate in a direction perpendicular to wires in the at least one layer of wires.

5. The wire sawing device of claim 4, wherein the at least one channel is located close to a bonding face of the mounting plate to which the at least one piece to be sawed is bonded, so that the at least one layer of wires penetrate into said mounting plate down to the at least one channel after having gone through the at least one piece to be sawed.

6. The wire sawing device of claim 4, in which the channel is connected with at least one fluid delivery.

7. A process of wire sawing at least one piece, comprising sawing the at least one piece using a wire sawing device that comprises a mounting plate that is formed by extrusion of a ceramic material and at least one groove formed on a face of the mounting plate; and a plurality of channels that are substantially parallel to each other and extending between two opposite sides of the mounting plate.

8. The process according to of claim 7, wherein the wire sawing the at least one piece is performed by use of at least one layer of wires stretched out between at least two wire guide cylinders, wherein the at least one layer of wires is disposed in grooves formed on the surface of the wire guide cylinders, and wherein sawing the at least one piece further comprises creating relative motion between the at least one layer of wires and the at least one piece while bearing the at least one piece, which is fastened to at least one support table and bonded to the mounting plate, against the at least one layer of wires to cause the wires of the layer of wires form sawing slots in the at least one piece.

9. The process of claim 8, further comprising circulating a cooling fluid through the plurality of channels when the wires in the layer of wires reach a depth in the at least one piece.

10. The process of claim 8, further comprising flowing a washing or rinsing liquid in the plurality of channels when the wires of the layer of wires penetrate at least one channel of the plurality of channels formed in the mounting plate to cause the flowing of washing or rinsing liquid to flow into the sawing slots.

11. The process of claim 8, further comprising flowing a heating fluid in the plurality of channels to provide heat to the mounting plate to facilitate the detachment of the slices from the mounting plate.

12. The wire sawing device according to of claim 1, wherein the plurality of channels are formed in the bulk of the mounting plate.

13. The process of claim 7, wherein the plurality of channels are formed in the mounting plate.

* * * * *

UNITED STATES PATENT AND TRADEMARK OFFICE

CERTIFICATE OF CORRECTION

PATENT NO. : 8,256,408 B2
APPLICATION NO. : 12/863177
DATED : September 4, 2012
INVENTOR(S) : Bucher et al.

It is certified that error appears in the above-identified patent and that said Letters Patent is hereby corrected as shown below:

In the Specification:

Column 1, Line 50, please delete "to";

Column 6, Line 62, please delete "is".

Signed and Sealed this
Eighth Day of January, 2013

David J. Kappos

David J. Kappos
*Director of the United States Patent and Trademark Office*